US008069918B2

(12) United States Patent
Zimmerman et al.

(10) Patent No.: US 8,069,918 B2
(45) Date of Patent: Dec. 6, 2011

(54) MAGNETIC SLIP RETENTION FOR DOWNHOLE TOOL

(75) Inventors: Patrick J. Zimmerman, Houston, TX (US); David Ward, Houston, TX (US); Jonathan Young, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 295 days.

(21) Appl. No.: 12/409,661

(22) Filed: Mar. 24, 2009

(65) Prior Publication Data

US 2010/0243232 A1 Sep. 30, 2010

(51) Int. Cl.
*E21B 23/01* (2006.01)

(52) U.S. Cl. ..... 166/217; 166/216; 166/382

(58) Field of Classification Search ..... 166/66.5, 166/216, 217, 382
See application file for complete search history.

(56) References Cited

U.S. PATENT DOCUMENTS

| | | | | |
|---|---|---|---|---|
| 2,131,274 | A * | 9/1938 | Crickmer | 166/130 |
| 3,006,416 | A * | 10/1961 | Roach et al. | 166/217 |
| 4,614,233 | A | 9/1986 | Menard | |
| 5,095,979 | A | 3/1992 | Perricone | |
| 5,273,109 | A | 12/1993 | Arizmendi et al. | |
| 5,540,279 | A | 7/1996 | Branch et al. | |
| 5,839,515 | A | 11/1998 | Yuan et al. | |
| 5,984,007 | A | 11/1999 | Yuan et al. | |
| 6,119,774 | A | 9/2000 | Doane et al. | |
| 6,568,470 | B2 | 5/2003 | Goodson, Jr. et al. | |
| 6,655,462 | B1 * | 12/2003 | Carmichael et al. | 166/311 |
| 2008/0149548 | A1 * | 6/2008 | White | 210/222 |
| 2009/0025927 | A1 * | 1/2009 | Telfer | 166/174 |

* cited by examiner

*Primary Examiner* — David Bagnell

*Assistant Examiner* — Richard Alker

(74) *Attorney, Agent, or Firm* — Wong, Cabello, Lutsch, Rutherford & Brucculeri, LLP

(57) ABSTRACT

A downhole tool, such as a packer or liner hanger, has a mandrel on which slips are disposed for engaging a surrounding tubular downhole. When the tool is being run in or out of the hole, at least one magnetic component magnetically retains the slip adjacent the mandrel so the slip can be held away from the surrounding tubular. When the tool is set downhole, the initial magnetic retention can be broken, and the slips can be moved away from the mandrel to engage the surface of the surrounding tubular.

14 Claims, 4 Drawing Sheets

MAGNETIC SLIP RETENTION FOR DOWNHOLE TOOL

BACKGROUND

When a downhole tool, such as a packer or liner hanger, is run downhole, fluid and debris traveling past the tool can sometimes move the tool's slips outward, potentially damaging the slips, hindering the tool's deployment, or affecting the function of the slips once the tool is set at depth.

In FIG. 1, for example, a slip 20 is positioned on a tool housing or mandrel 10 between a movable wedge 12 and another (fixed or movable) wedge 14. When the tool mandrel 10 is set at depth, activation of the tool moves the wedges 12 and 14 closer together to push the slip away from the mandrel 10 so it can engage the inside of a surrounding tubular. To retain the slip 20 during deployment, a plurality of rings 30 fit through the slip 20 and around the mandrel 10. When the wedges 12/14 are separated as shown, the rings 30 hold the slip 20 next to the mandrel 10 so that the slip 20 does not extend beyond the tool's profile. When pushed out from the mandrel 10, however, the slip 20 overcomes the hold of the rings 30.

In addition to rings, other features such as springs, shear pins, and cages may be used to retain the slips in place until the tool is set at its desired depth. For example, a bow or leaf spring 32 can be positioned in FIG. 1 between the cage 16 and the slip 20 to bias the slip 20 against the mandrel 10. Although some of these features can retain the slip 20 while the tool is both run-in and pulled-out-of the hole, retaining the slips 20 with some of these features can be used only for running-in hole. For example, a shear pin may no longer be used to retain the slip once broken. Therefore, problems with debris and fluid passing around the unretained slip may occur as the tool is pulled out of the hole.

Although shown in a diagrammatic fashion in FIG. 1, use of the rings 30 (as well as other features such as springs, pins, and the like) to mechanically retain the slips 20 typical requires some mechanical complexity to achieve the desired retention on an actual tool. The mechanical complexity makes manufacture and assembly of a tool more involved and expensive, and can lead to a higher potential for mechanical failure in the tool. What is needed is a technique to retain slips on a downhole tool that requires less complexity and that can be effective as the tool is run-in and pulled-out-of a hole.

DETAILED DESCRIPTION

Rather than relying solely on mechanically retaining slips on a tool by using rings, springs, shear pins, cages, or the like, FIGS. 2A-2D illustrate several ways to retain slips in place using magnetic components while a tool is run-in and pulled-out-of a hole. The tool can be any tool that has retractable slips or other gripping or cutting devices used to engage a surrounding tubular when set at depth in a hole. For example, the downhole tool can be a packer, a liner hanger, a plug, or a tubing stop. The magnetic components can replace or augment any springs or other features that mechanically retain the slips on such tools.

As the setting force is applied to the tool (e.g., packer, liner hanger, etc.), the force pulls the slip away from the magnetic component that retains the slip, allowing the slip to engage a surrounding tubular. The magnetic component can be inserted into the tool's mandrel, into the slip, or into both the mandrel and the slip. The magnetic component can also be affixed to the mandrel or to some other component that retains the slip. Using the magnetic component advantageously reduces the mechanical complexity required to retain the slip on a tool and eliminates the creation of debris.

Figure 1:
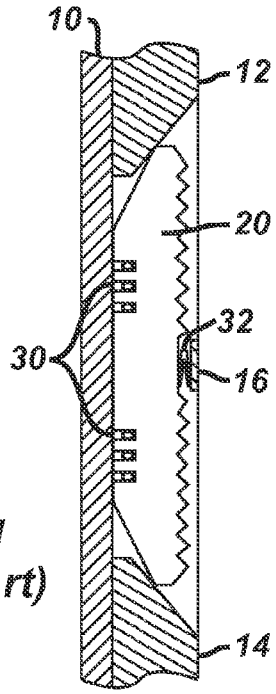
FIG. 1 (Prior Art)
FIG. 1 illustrates a slip held to a mandrel using rings according to the prior art.
Figure 2A:
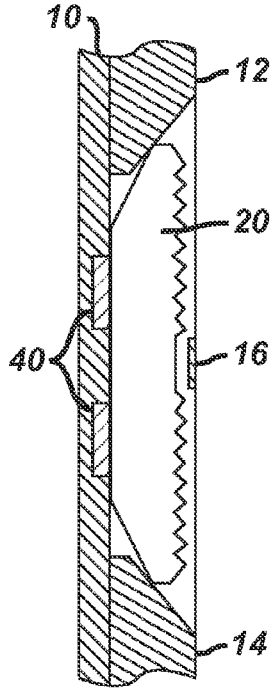
FIG. 2A illustrates a slip held to a mandrel using magnets on the mandrel.

In FIG. 2A, a slip 20 is positioned adjacent a tool mandrel 10 between activation bodies (e.g., wedge members) 12 and 14. A center strip 16 of a cage that may be part of the tool's mandrel 10 may ultimately prevent the slip 20 from becoming loose from the mandrel 10. In addition to or in place of any rings or other mechanical features, one or more magnetic components 40 on the mandrel 10 retain the slip 20 adjacent the mandrel 10 as long as a setting force is not applied by the wedge members 12 and 14. In this arrangement, the slip 20 can be composed of a ferromagnetic material, such as steel or the like, allowing it to be attracted to the magnetic components 40 on the mandrel 10. For its part, the mandrel 10 can also be composed of a ferromagnetic material, but could be composed of something else, such as a composite or other non-ferromagnetic material.

Although two magnetic components 40 are shown in FIG. 2A, only one or more than two magnetic components 40 can be used depending on the size of the slip 20 and depending on the power of the magnetic force required, along with other factors. For their part, these magnetic components 40 can be rare earth magnets or other types of permanent magnets. In addition, the magnetic components 40 can be affixed to the mandrel 10 using any common technique. For example, the magnetic components 40 can be positioned in milled slots in the mandrel's outside surface and either welded or screwed therein or retained by a bracket member, cover, or other holding feature (not shown).

Figure 2B:
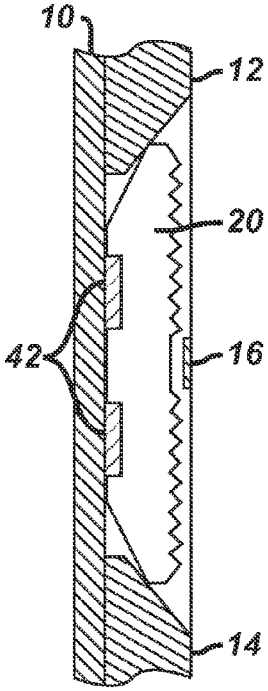
FIG. 2B illustrates a slip held to a mandrel using magnets on the slip.

In a reverse arrangement shown in FIG. 2B, magnetic components 42 on the slip 20 itself retain the slip 20 against the mandrel 10. Here, the mandrel 10 is made of a ferromagnetic material attractive to the magnetic components 42, which can be composed of rare earth magnets or the like. The slip 20 can be composed of any desirable material.

Figure 2C:
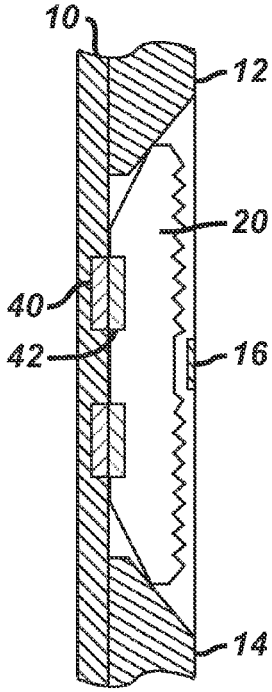
FIG. 2C illustrates a slip held to a mandrel using attracting magnets on the mandrel and the slip.

In a complimentary arrangement shown in FIG. 2C, magnetic components 40 and 42 on both the mandrel 10 and the slip 20 retain the slip 20 against the mandrel 10. These facing magnetic components 40 and 42 attract one another in an attractive relation to hold the slip 20. For example, the components 40 and 42 may both be permanent magnets with one (e.g., 40) having a North orientation and the other (e.g., 42) having a South orientation. Alternatively, one of the components 40/42 can be a permanent magnet, while the other can be a ferromagnetic element.

Figure 2D:
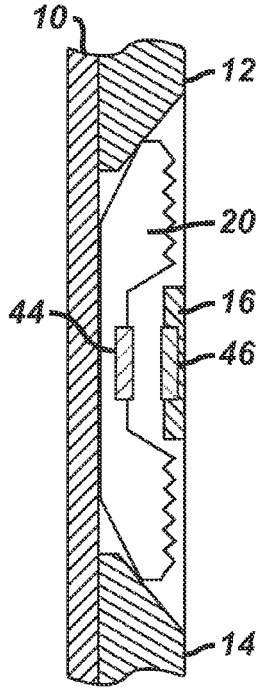
FIG. 2D illustrates a slip held to a mandrel using opposing magnets on the mandrel and the slip.

In a reverse arrangement shown in FIG. 2D, magnetic components 44 and 46 both on the slip 20 and portion 16 of the mandrel 10 retain the slip 20 against the mandrel 10. Here, the facing magnetic components 44 and 46 are permanent magnets that oppose one another in a repulsive relation (e.g., North-to-North or South-to-South polarity configuration). In this way, the magnetic repulsion forces the slip 20 against the mandrel 10 as long as the wedge members 12 and 14 remain separated. As shown, the magnetic component 46 on the mandrel 10 can be disposed on a cage portion 16 that limits the slip 20's movement, but the component 46 could be positioned elsewhere on the mandrel 10.

Figure 3:
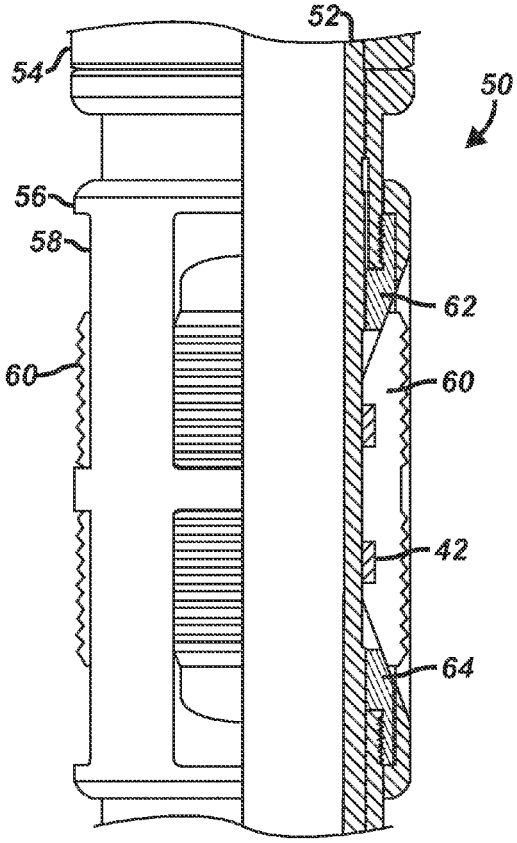
FIG. 3 illustrates portion of a packer having slips held to the valve's mandrel using magnets on the slip.

Use of such magnetic components (e.g., 40, 42, 44, 46) to retain slips 20 on a tool can be applied to a number of different downhole tools and slip arrangements, some of which are shown in FIGS. 3 through 7. For example, FIG. 3 shows a portion of a packer 50 for passing in tubing and isolating the annulus. The packer 50 has a mandrel 52, a packing element 54, and slip cage 56 with slots 58. Slips 60 position in the cage's slots 58 and can be pushed outward from the mandrel 52 by wedge members 62 and 64. One or more magnetic components 42 retain on the slip 60 against the mandrel 52 (composed of ferromagnetic material), while the packer 50 is run-in and pulled-out-of tubing so that the slips 60 do not extend beyond the slots 58 and the cage 56's profile.

Figure 4:
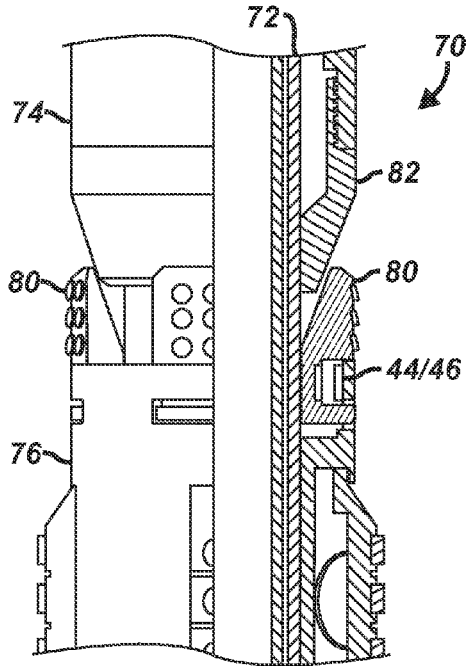
FIG. 4 illustrates portion of a compression-set retrievable service packer having slips held to the packer's mandrel using opposing magnets on the slip and mandrel.

FIG. 4 shows a portion of a compression-set retrievable service packer 70 used to isolate a wellbore annulus from a production conduit. The packer 70 has a mandrel 72 with upper and lower mandrels 74 and 76. Slips 80 position between the mandrels 72 and 74 and are held partially in slots in the lower mandrel 76. Opposing permanent magnets 44 and 46 (one 44 on the slip 80 and another 46 on the lower mandrel 76) retain the slips 80 against the mandrel 72. When the space decreases between the upper and lower mandrels 72 and 74 during activation, a wedge portion 82 pushes the slips 80 out from the mandrel 72 against the opposing force of the permanent magnets 44 and 46.

Figure 5:
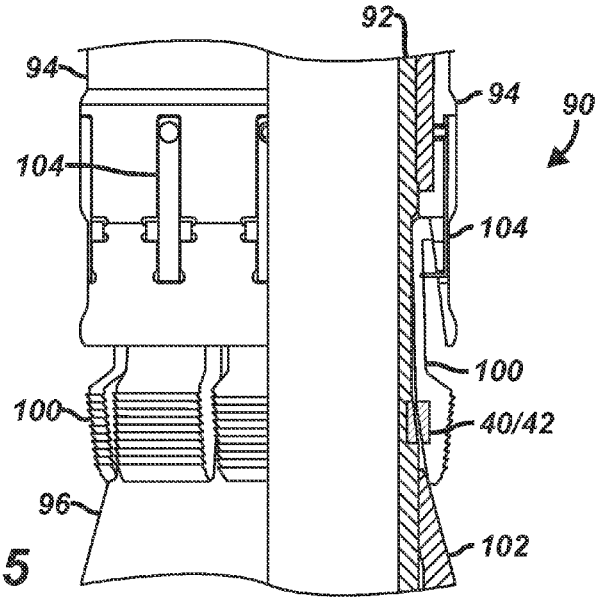
FIG. 5 illustrates portion of a retrievable bridge plug having slips held to the packer's mandrel using attracting magnets on the slip and mandrel.

FIG. 5 shows a portion of a retrievable bridge plug 90 used for plugging tubing downhole. The plug 90 has a mandrel 92 with upper and lower mandrels 94 and 96 positioned thereon. Slips 100 have one end fixed to pivot at the upper mandrel 94 and have another end to engage a surrounding tubular when jarring movements push the lower mandrel's wedge member 102 against the slips 100. In addition or alternative to springs 104 that mechanically retain the slips 100, attractive magnetic components 40 and 42 respectively on the mandrel 92 and slips 100 retain the slips 100 adjacent the mandrel 92 as long as the tool is not set. Both components 40 and 42 can be permanent magnets to attract one another. Alternatively, one can be a permanent magnet, while the other can be a ferromagnetic element.

Figure 6:
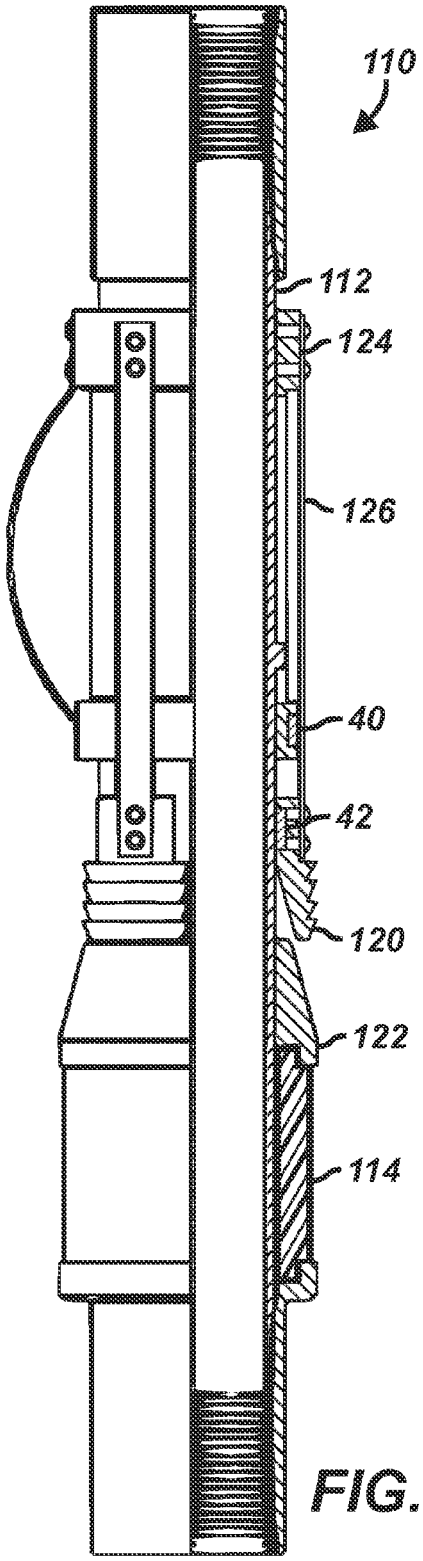
FIG. 6 illustrates portion of a retrievable casing packer having slips held to the packer's mandrel using separately located magnets on the slip and mandrel.

FIG. 6 shows a retrievable casing packer 110 used to isolate a wellbore annulus from a production conduit for low-pressure production, water-injection, and pressure applications. The packer 110 has slips 120 held by wickers 126 to a retention ring 124 on the mandrel 112. Separately located magnets 40 and 42 retain the slips 120 to the mandrel 112 when the packer 110 is not set. For example, first magnets 40 on the mandrel 112 (at an intermediate ring) magnetically attract the slip's wickers 126, which can be made of a ferromagnetic material. In addition, second magnets 42 on the underside on the ends of the slips 120 magnetically attract to the packer's mandrel 112 also composed of ferromagnetic material.

Figure 7:
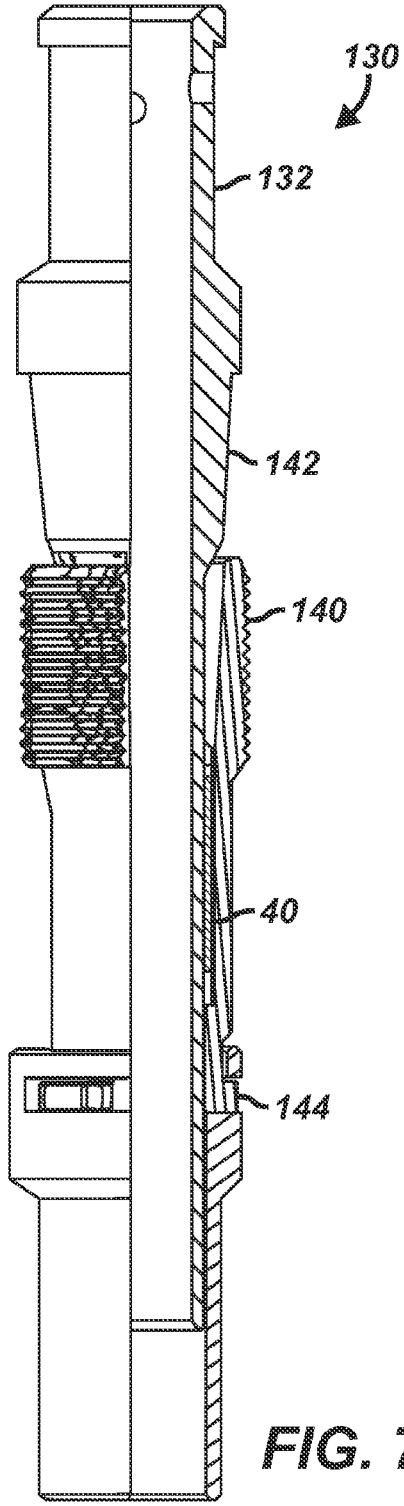
FIG. 7 illustrates a tubing stop having slips held to the packer's mandrel using magnets on the mandrel.

FIG. 7 shows a portion of a tubing stop 130 for setting in tubing and holding force from above from a gas lift bumper spring or the like. The stop 130 has slips 140 pivotably anchored at one end 144 and engagable by a wedge portion 142 of the mandrel 132 to be pushed outward toward a surrounding tubular. One or more large magnetic elements 40 in form of a sleeve on the stop's mandrel 132 retain the slips 140 to the mandrel 132 while not engaged by the wedge portion 142. In addition to a sleeve shape, the elements 40 can have other suitable shapes.

Figure 8:
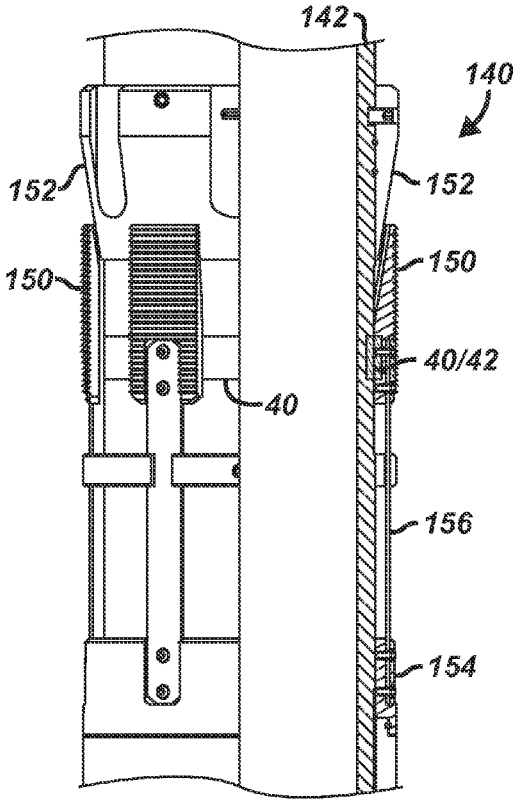
FIGS. 8, 9, and 10 illustrate liner hangers having slips held using various arrangements of magnetic components.
Figure 9:
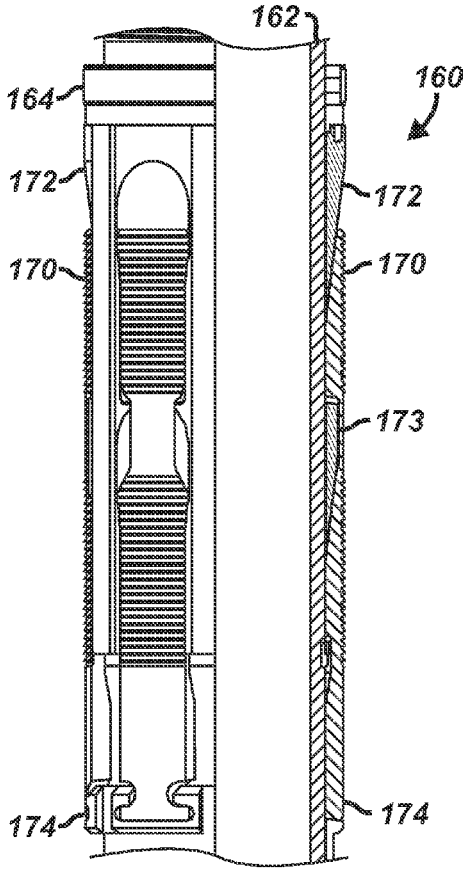
Figure 10:
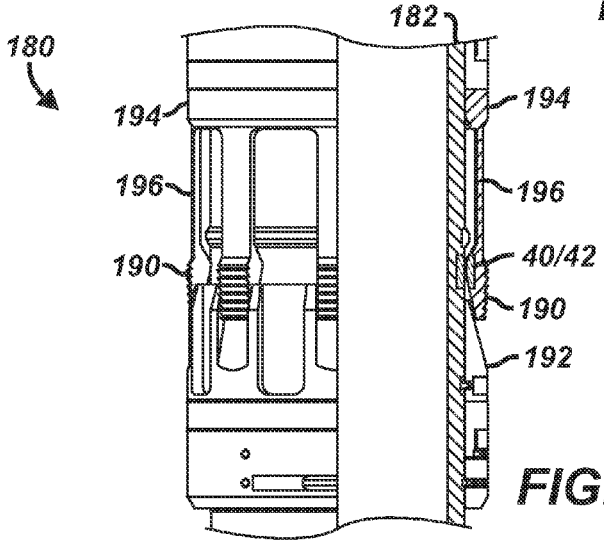

FIGS. 8, 9, and 10 show liner hangers 140, 160, and 180 having slips held using various arrangements of magnetic components. In FIG. 8, for example, the liner hanger 140 has a mandrel 142 and a wedge member 152. Slips 150 have wickers 156 with ends 154 attached adjacent the mandrel 142. The slip 150s' second ends are movable by the wedge member 152 to engage a surrounding tubular. First and second magnetic components 40 and 42 on the mandrel 142 and slips 150 retain the slips' ends adjacent the mandrel 142 while the hanger 140 is run in and out of the hole. Once the wedge member 152 activates the slips 150, the magnetic retention is broken so the slips 150 can engage the surrounding tubular. The magnetic components 40 on the mandrel 142 can include a plurality of discrete permanent magnets disposed on the mandrel. Alternatively as shown, the magnetic component 40 can actually be a ring of permanent magnet material disposed around the outside of the mandrel 142.

In FIG. 9, the liner hanger 160 has a mandrel 162 and dual wedges 172/173 for activating slips 170. As shown, one end 174 of the slip 170 is pivotably connected to a cage 164 on the mandrel 162, and the slip 170 is held within slots in the cage 164. As long as the wedges 172/173 remain in the position shown in FIG. 9, the slips 170 are held adjacent to the mandrel 162.

Here, the wedges 172/173 are composed either entirely or partially of permanent magnetic material, and the slips 170 are either composed entirely or partially of ferromagnetic material, permanent magnetic material, or a combination thereof to be attracted to the wedges 172/173. Alternatively, the reverse arrangement is possible where the slips 170 are composed either entirely or partially of a permanent magnetic material and the wedges 172/173 are either composed entirely or partially ferromagnetic material, permanent magnetic material, or a combination thereof to be attracted to the slips 170.

In FIG. 10, the liner hanger 180 has a mandrel 182, wedge member 192, and slip ring 194. The ring 194 has slip ends 190 that extend along slip springs 196 from the ring 194. Magnetic components 40/42 on the slip ends 190 and the adjacent portion of the mandrel 182 retain the slip ends 190 in place until activated by the wedge member 192.

In any of the arrangement disclosed above, one or more magnetic components can be used. The magnetic components can be a ferromagnetic element or a permanent magnet, such as a rare earth magnet. In addition, the slips, wedges, or mandrel (either entirely or a portion thereof) can be composed of a permanent magnetic material. It is possible that downhole debris may be attracted to any permanent magnets used on the downhole tool. The extent of this issue depends on the size and strength of any permanent magnets used for a given implementation. However, the magnets are preferably not outwardly exposed on the downhole tool to avoid or minimize the collection of debris. For example, permanent magnets used for the arrangement of magnetic components

40/42 in FIG. 5 will not be outwardly exposed on the tool 90 when the slips 100 are retained as shown or even when extended outwardly because the wedge 102 will at least partially cover the elements 40/42 on the mandrel 92 and slip 100. The other arrangements disclosed herein may also have similar benefits.

Although the magnetic components are shown in the drawings as being exposed on the surfaces of the slip, mandrel, wedges, etc., it may be preferred to embed the magnetic components inside these elements. This may be useful depending on the magnetic material used and its ability to withstand direct contact with the downhole environment. Embedding the magnetic component may also be useful when the exposed portion of the slip, mandrel, wedge, etc. encounters friction or the like. For example, the magnetic components 40/42 on the liner hanger of FIG. 10 may be exposed to friction when the slips 190 ride on the wedge 192 to extend outward from the mandrel 182. Depending on the material used, it may be preferred that the magnetic component 42 on the slip 190 not be outwardly exposed and caused to ride directly on the wedge 192.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising:

a mandrel;

an activation body disposed on the mandrel;

a slip disposed on the mandrel, at least a portion of the slip being movable by the activation body from a first position adjacent the mandrel to a second position away from the mandrel for engaging a surrounding surface; and at least one magnetic component magnetically retaining the slip in the first position, wherein the at least one magnetic component comprises a first magnetic component disposed on the slip and a second magnetic component disposed on the mandrel, the first and second magnetic components being magnetically attracted to one another.

2. The tool of claim 1, wherein the tool is selected from the group consisting of a packer, a liner hanger, a plug, and a tubing stop.

3. The tool of claim 1, wherein the at least one magnetic component comprises a permanent magnet.

4. The tool of claim 1, wherein the first and second magnetic components comprise permanent magnets with attracting polarities.

5. The tool of claim 1, wherein the first magnetic component comprises a permanent magnet, and wherein the second magnetic component comprises a ferromagnetic material.

6. The tool of claim 1, wherein the at least one magnetic component comprises a plurality of permanent magnets.

7. The tool of claim 1, wherein the first magnetic component comprises a ferromagnetic material, and wherein the second magnetic component comprises a permanent magnet.

8. The tool of claim 1, further comprising additional means for retaining the slip in the first position until moved by the activation body to the second position.

9. A downhole tool, comprising:

a mandrel;

an activation body disposed on the mandrel; and a slip disposed on the mandrel, at least a portion of the slip being movable by the activation body from a first position adjacent the mandrel to a second position away from the mandrel for engaging a surrounding surface, the slip having a first permanent magnet magnetically retaining the slip in the first position, wherein the mandrel comprises a second permanent magnet magnetically attractable to the first permanent magnet.

10. The tool of claim 9, wherein the tool is selected from the group consisting of a packer, a liner hanger, a plug, and a tubing stop.

11. The tool of claim 9, further comprising additional means for retaining the slip in the first position until moved by the activation body to the second position.

12. A downhole tool, comprising:

a mandrel having a first permanent magnet;

an activation body disposed on the mandrel; and a slip disposed on the mandrel, at least a portion of the slip being movable by the activation body from a first position adjacent the mandrel to a second position away from the mandrel for engaging a surrounding surface, the slip magnetically retained in the first position by the first permanent magnet, wherein the slip comprises a second permanent magnet magnetically attractable to the first permanent magnet.

13. The tool of claim 12, wherein the tool is selected from the group consisting of a packer, a liner hanger, a plug, and a tubing stop.

14. The tool of claim 12, further comprising additional means for retaining the slip in the first position until moved by the activation body to the second position.

* * * * *